US009765656B2

(12) United States Patent
Beyer et al.

(10) Patent No.: US 9,765,656 B2
(45) Date of Patent: Sep. 19, 2017

(54) HYDRAULIC CIRCUIT FOR VALVE DEACTIVATION

(71) Applicant: Ford Global Technologies, LLC, Dearborn, MI (US)

(72) Inventors: Theodore Beyer, Canton, MI (US); Charles Joseph Patanis, South Lyon, MI (US); Jon Michael LaCroix, Novi, MI (US); Joseph Keenan, Flat Rock, MI (US); Jonathan Denis Crowe, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 29 days.

(21) Appl. No.: 14/740,011

(22) Filed: Jun. 15, 2015

(65) Prior Publication Data

US 2016/0363012 A1 Dec. 15, 2016

(51) Int. Cl.
*F01L 9/02* (2006.01)
*F01L 13/00* (2006.01)
(Continued)

(52) U.S. Cl.
CPC ..... *F01L 13/0005* (2013.01); *F01L 1/047* (2013.01); *F01L 1/18* (2013.01); *F01L 1/2405* (2013.01); *F01L 9/02* (2013.01); *F01L 2001/0476* (2013.01); *F01L 2001/054* (2013.01); *F01L 2001/0537* (2013.01); *F01L 2001/186* (2013.01); *F01L 2013/001* (2013.01); *F01L 2105/00* (2013.01); *F02F 1/24* (2013.01)

(58) Field of Classification Search
CPC ..... F01L 13/0005; F01L 1/24; F01L 1/2405; F01L 9/02; F01L 2001/0537; F01L 2013/001
USPC ..... 123/90.12, 90.13
See application file for complete search history.

(56) References Cited

U.S. PATENT DOCUMENTS 5,544,548 A 8/1996 Ihara et al.
6,196,175 B1 3/2001 Church
(Continued)

FOREIGN PATENT DOCUMENTS

EP 1568851 A1 8/2005
EP 1892387 A1 2/2008

OTHER PUBLICATIONS

Pietrzyk, P. et al., "Method and System for Variable Cam Timing Device," U.S. Appl. No. 14/520,174, filed Oct. 21, 2014, 98 pages.
(Continued)

*Primary Examiner* — Ching Chang
(74) *Attorney, Agent, or Firm* — Greg Brown; McCoy Russell LLP

(57) ABSTRACT

Methods and systems are provided for deactivating a valve actuation mechanism. In one example, a system may include a hydraulic gallery that may deliver a restricted flow of hydraulic fluid from a hydraulic flow restrictor to a pressure relief valve within a valve deactivation oil control valve, and during a second condition may deliver an unrestricted flow of hydraulic fluid from the valve deactivation oil control valve to the hydraulic flow restrictor. The hydraulic flow restrictor may comprise two vertical bores within the camshaft carrier that are fluidically coupled via a restrictive groove on the bottom surface of the camshaft carrier.

16 Claims, 8 Drawing Sheets

(51) Int. Cl.

| | |
|---|---|
| ***F01L 1/047*** | (2006.01) |
| ***F01L 1/18*** | (2006.01) |
| ***F01L 1/24*** | (2006.01) |
| *F02F 1/24* | (2006.01) |
| *F01L 1/053* | (2006.01) |

(56) References Cited

U.S. PATENT DOCUMENTS

| | | | | |
|---|---|---|---|---|
| 6,230,668 | B1 | 5/2001 | Marsh et al. | |
| 6,584,951 | B1 | 7/2003 | Patel et al. | |
| 6,758,175 | B2 | 7/2004 | Dinkel et al. | |
| 6,976,463 | B2 | 12/2005 | Spath et al. | |
| 7,047,925 | B2 | 5/2006 | Hendriksma et al. | |
| 7,174,866 | B2 | 2/2007 | Hildebrandt | |
| 7,174,869 | B2 | 2/2007 | Proschko et al. | |
| 7,827,944 | B2 * | 11/2010 | Pierik | F01L 1/185 123/90.12 |
| 7,946,262 | B2 | 5/2011 | Borraccia et al. | |
| 8,464,675 | B2 | 6/2013 | Waters et al. | |
| 8,640,664 | B2 | 2/2014 | Lee | |
| 8,662,035 | B1 | 3/2014 | Hendriksma | |
| 8,695,551 | B2 | 4/2014 | Langewisch et al. | |
| 2014/0245735 | A1 | 9/2014 | Kuske et al. | |
| 2014/0283776 | A1 | 9/2014 | Smith et al. | |
| 2014/0290608 | A1 | 10/2014 | Radulescu | |

OTHER PUBLICATIONS

Crowe, J. "Hydraulic Circuit for Valve Deactivation," U.S. Appl. No. 14/665,448, filed Mar. 23, 2015, 54 pages.

McConville, G. "External Oil Groove on a Hydraulic Lash Adjuster," U.S. Appl. No. 14/698,493, filed Apr. 28, 2015, 56 pages.

* cited by examiner

HYDRAULIC CIRCUIT FOR VALVE DEACTIVATION

FIELD

The present description relates generally to valve actuating mechanisms for engines.

BACKGROUND/SUMMARY

Variable displacement engines may employ a valve deactivation assembly including a rolling finger follower that is switchable from an activated mode to a deactivated mode. One method for activating and deactivating the rocking arm includes an oil-pressure actuated latch pin within the inner arm of the rolling finger follower. In a first mode, the pin engages the inner arm and outer arm in a latched condition to actuate motion of the outer arm, thereby moving a poppet valve that controls one of the intake or exhaust of gases in the combustion chamber. In a second mode, the inner arm is disengaged from the outer arm in an unlatched condition, and the motion of the inner arm is not translated to the poppet valve.

Mode transitions, either from the latched condition to the unlatched condition, or vice versa, may be designed to occur only when the cam is on the base circle portion. For example, mode transitions may be controlled to occur only when the roller follower is engaging the base circle portion of the cam. This ensures that the mode change occurs while the valve deactivator assembly, and more specifically the latching mechanism, is not under a load.

Due to the high rotational speed of a cam, it may be difficult to reduce the amount of time needed to transition from a latched condition to an unlatched condition in order to execute the transition during a single base circle period. The inventors have recognized that one problematic issue that may arise during mode transitions in a rolling finger follower with an oil-pressure actuated latch pin is the presence of air within the latch pin circuit, which is compressible and increases the amount of time needed to switch from the latched condition to the unlatched condition or vice versa.

Other attempts to address entrapped air within the deactivation circuit include air expansion chambers. One example approach is shown by Hendriksma in U.S. Pat. No. 8,662,035. Therein, a pressure differential within the hydraulic circuit is utilized to flow the entrapped air through first and second flow constriction region of an oil bypass passage. By configuring the second flow constriction region to be less constricting than the first, the first and second flow constriction regions establish a pressure differential therebetween. Air may expand in the volume between each constriction region at a reduced rate by means of the pressure differential, thereby reducing pressure oscillations within the hydraulic circuit caused by a more rapid expansion of air.

However, the inventors herein have recognized potential issues with such systems. As one example, particulate matter within the oil may accumulate at one or more of the flow constriction regions. The particulate matter may degrade the constricting of the oil, and may thereby reducing the reliability of the pressure differential established between the flow constriction regions. Thus, the reduction of pressure oscillations may become less reliable.

Other attempts to address the accumulation of particulate matter at a flow constriction region include a combined restrictor/filter to insert within a lifter oil manifold assembly. One example approach is shown by Borraccia et al. in U.S. Pat. No. 7,946,262. Therein, an unrestricted oil pump feed flows through a combined restrictor/filter to supply a restricted amount of oil to the deactivatable valve lifters of the engine. The combined restrictor/filter is configured to rest atop a dam that directs the flow through a filter, an internal passageway, and a restriction orifice of the restrictor/filter.

However, the inventors herein have recognized potential issues with such systems. As one example, even with a sealant, leakage may still occur at the interface of the dam and the restrictor/filter, thereby bypassing the restriction orifice and creating unpredictable pressures downstream of the restriction orifice. Additionally, if filter degradation is present, the entire restrictor/filter unit may need to be replaced, introducing high maintenance costs.

In one example, the issues described above may be addressed by a hydraulic circuit for a poppet valve deactivation mechanism of an engine, comprising a poppet valve deactivation control valve including an outlet that is in communication with first and second oil galleries, the galleries also each in communication with a DHLA, and a hydraulic flow restriction hydraulically in series between the first and second galleries, said hydraulic flow restriction including a restricted horizontal groove in a camshaft carrier that fluidly couples a first vertical bore to a second vertical bore.

As one example, the first and second oil galleries may be in communication with a dual-function hydraulic lash adjuster. During activated cylinder conditions, pressure in the first oil gallery may be greater than in the second oil gallery, and oil may flow from the first gallery to the second gallery via the restricted horizontal groove. The hydraulic flow restriction may be machined into a bottom face of a camshaft carrier. The direction of flow during the activated cylinder conditions may be such that any air in the second gallery flows with the restricted flow of oil toward a pressure relief valve in a valve deactivation oil control valve. Each vertical bore may include an interchangeable oil filter to reduce the amount of particulate matter within the oil before the oil flows through the restrictive groove. In this way, the amount of air within the hydraulic circuit may be reliably reduced, and the degradation of the restrictor of the deactivation circuit due to accumulated particulate matter may also be reduced. Additionally, by machining the hydraulic flow restrictor into the bottom of the camshaft carrier, leakage and packing constraints may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2A:
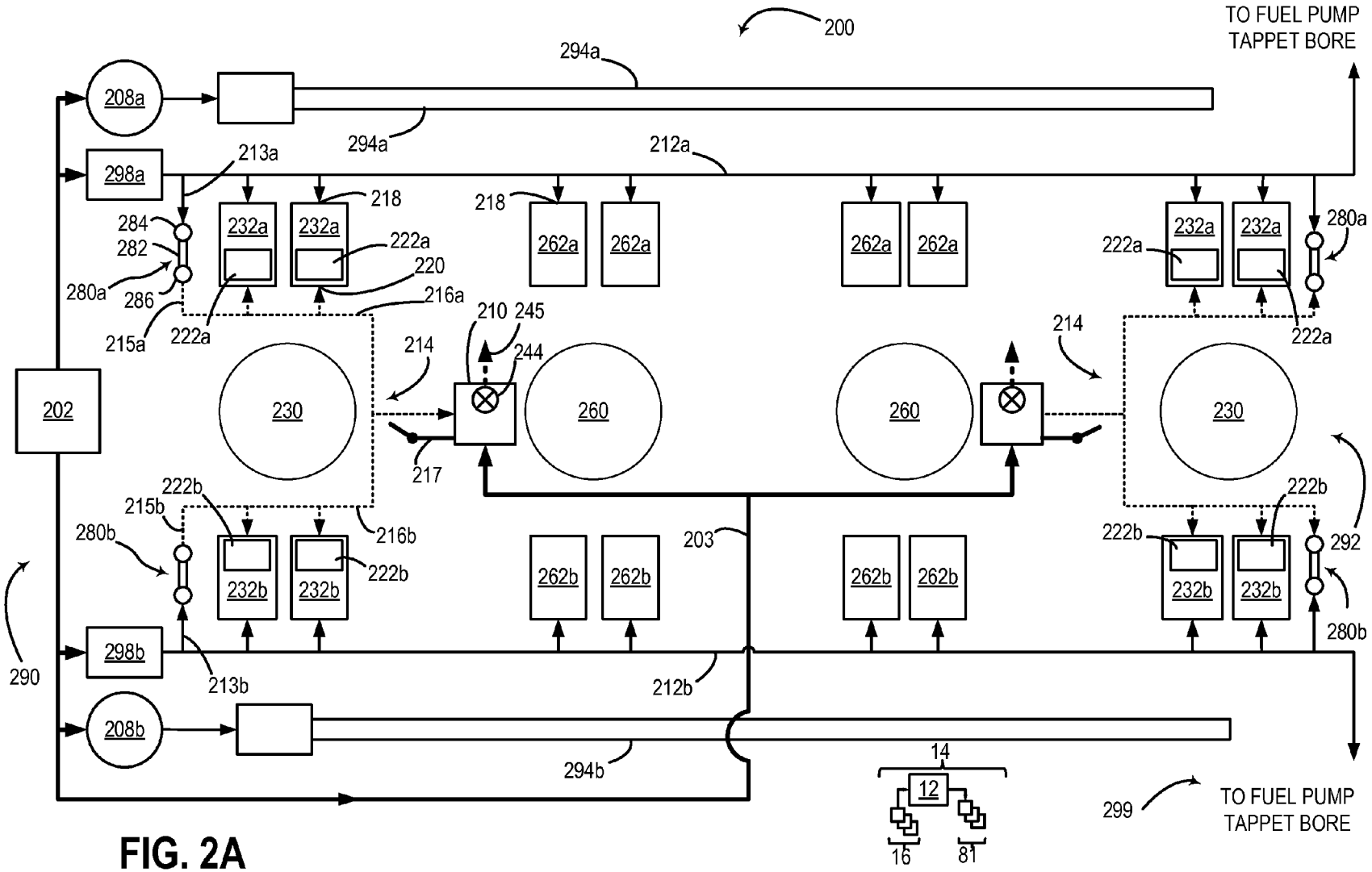
FIG. 2A provides a block diagram of a hydraulic circuit for activating and deactivating a VDE cylinder operating in a first mode.
Figure 2B:
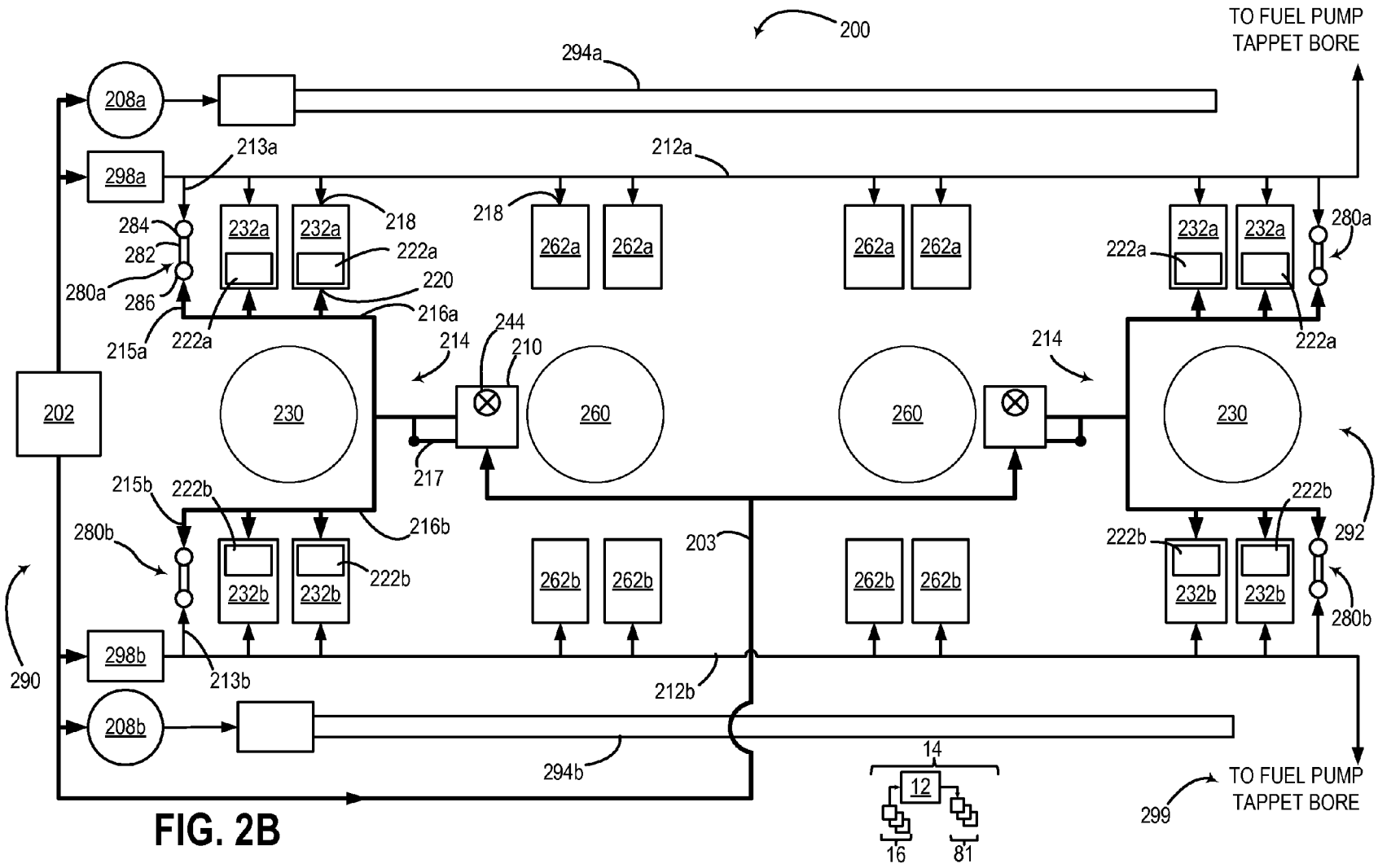
FIG. 2B provides a block diagram of a hydraulic circuit for activating and deactivating a VDE cylinder operating in a second mode.
Figure 3:
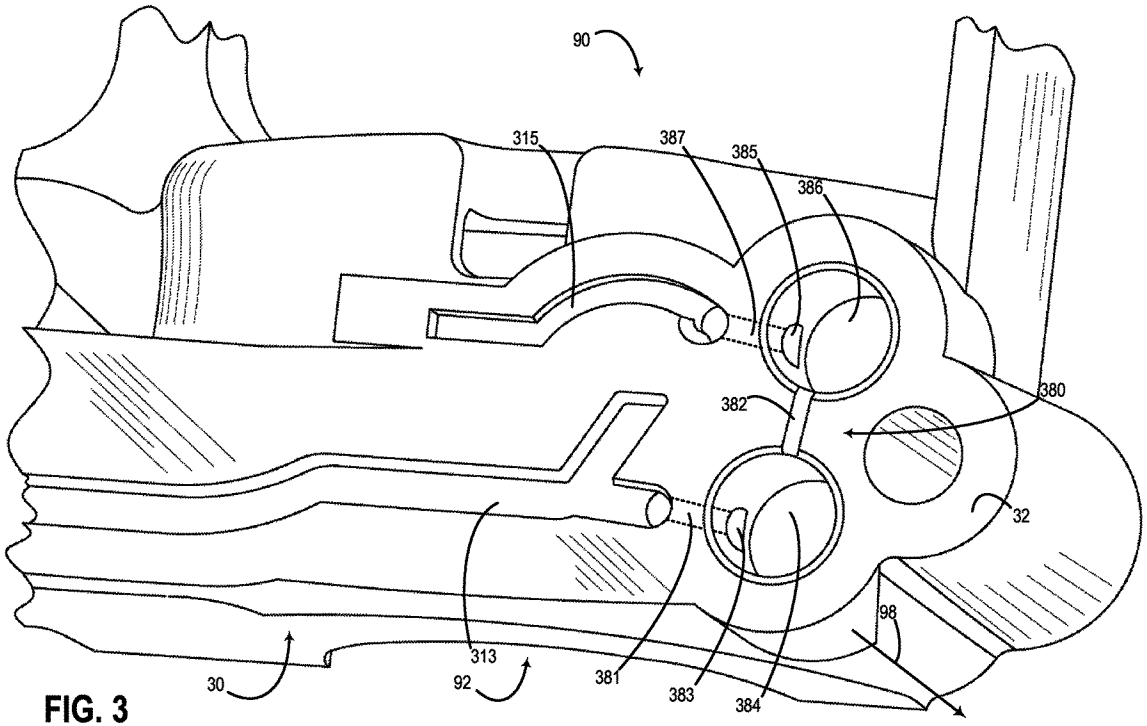
FIG. 3 shows a first embodiment of a hydraulic flow restrictor formed in a bottom surface of the camshaft carrier.
Figure 4:
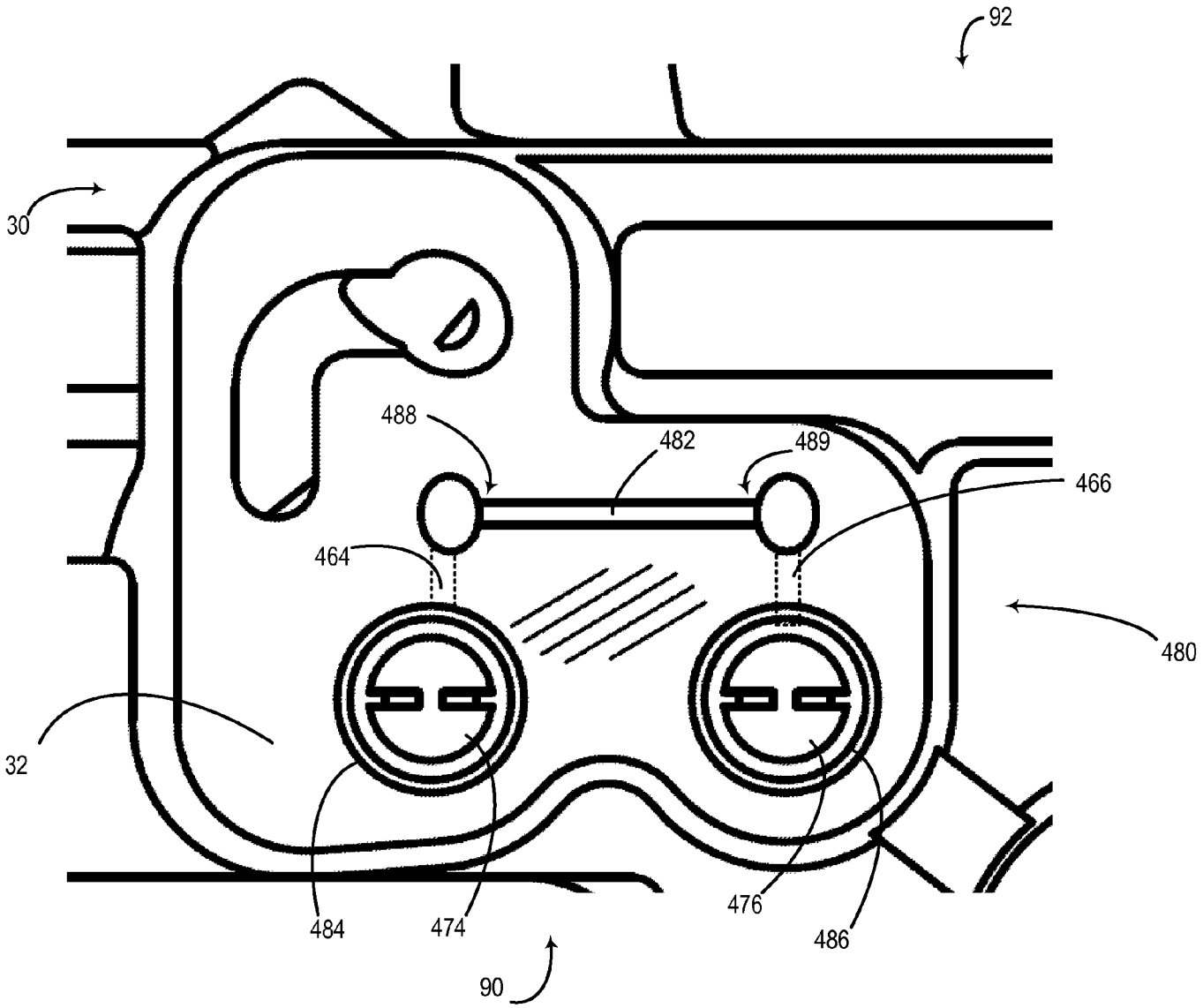
FIG. 4 shows a second embodiment of a hydraulic flow restrictor formed in a bottom surface of the camshaft carrier.
Figure 5:
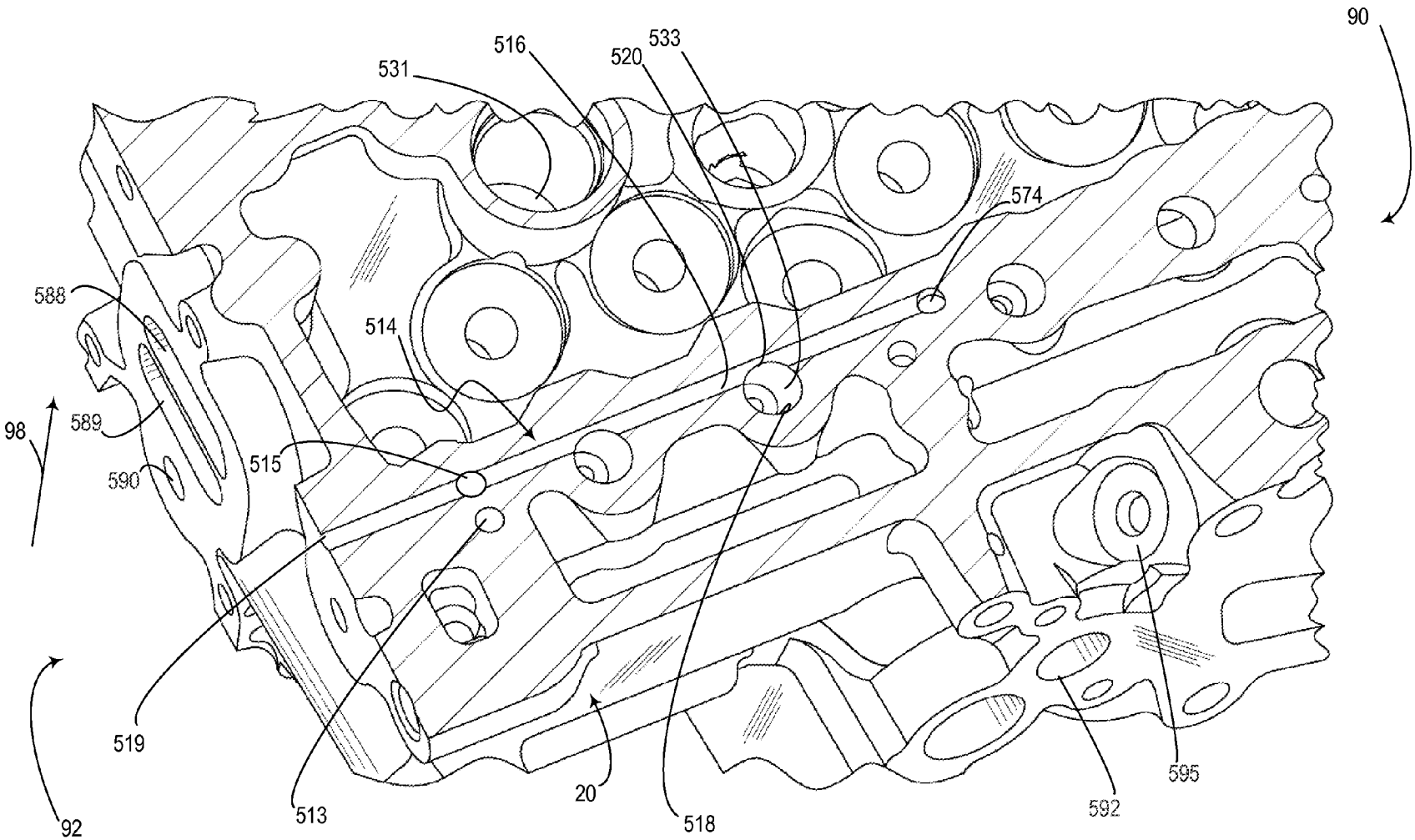
FIG. 5 shows the location of an axial passage of a switching gallery within the cylinder head, and the fluidic connectivity of the axial passage to the hydraulic flow restrictor.
Figure 6:
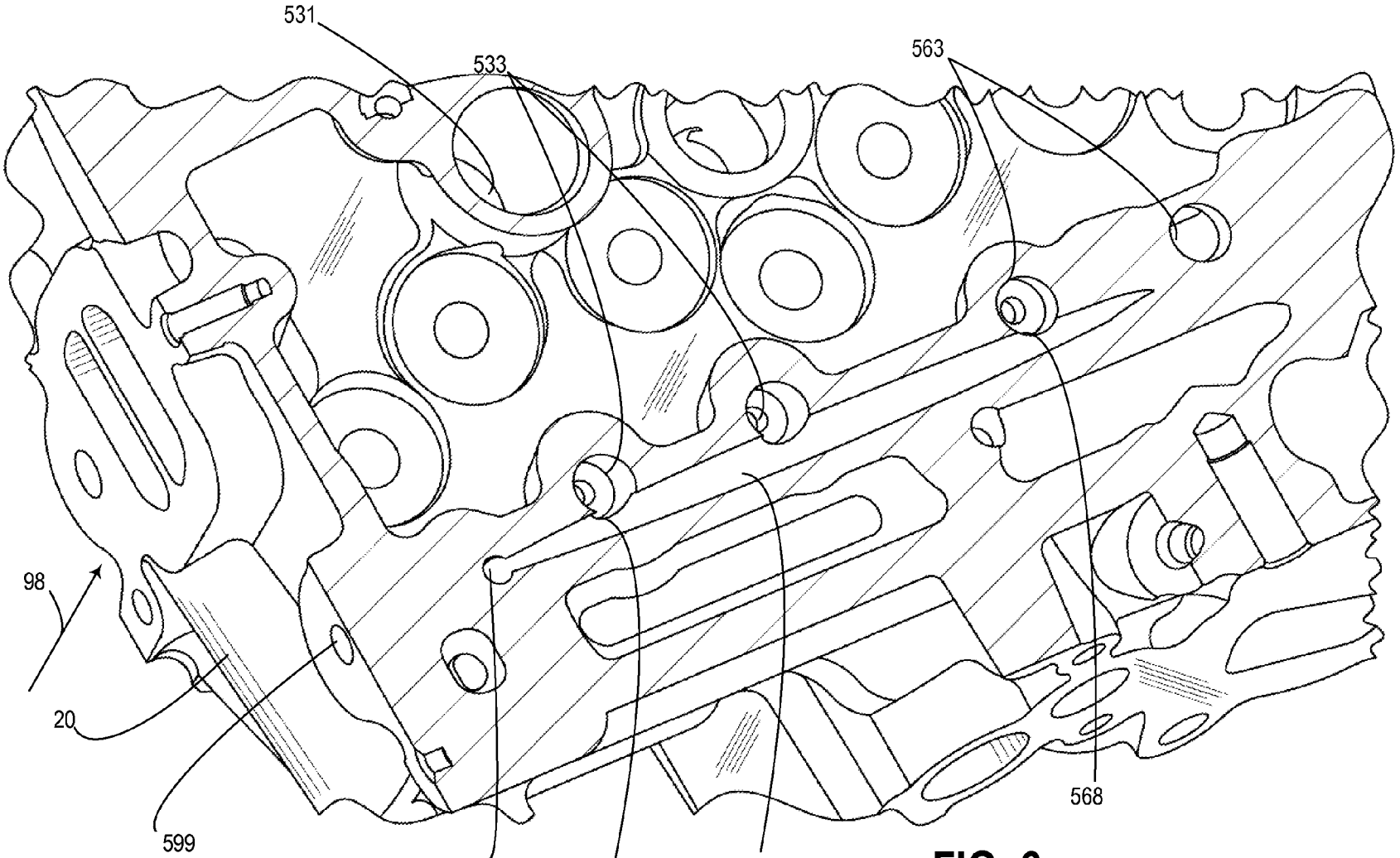
FIG. 6 shows the location of an HLA gallery within the cylinder head, and the fluidic connectivity of the HLA gallery to the hydraulic flow restrictor.
Figure 7:
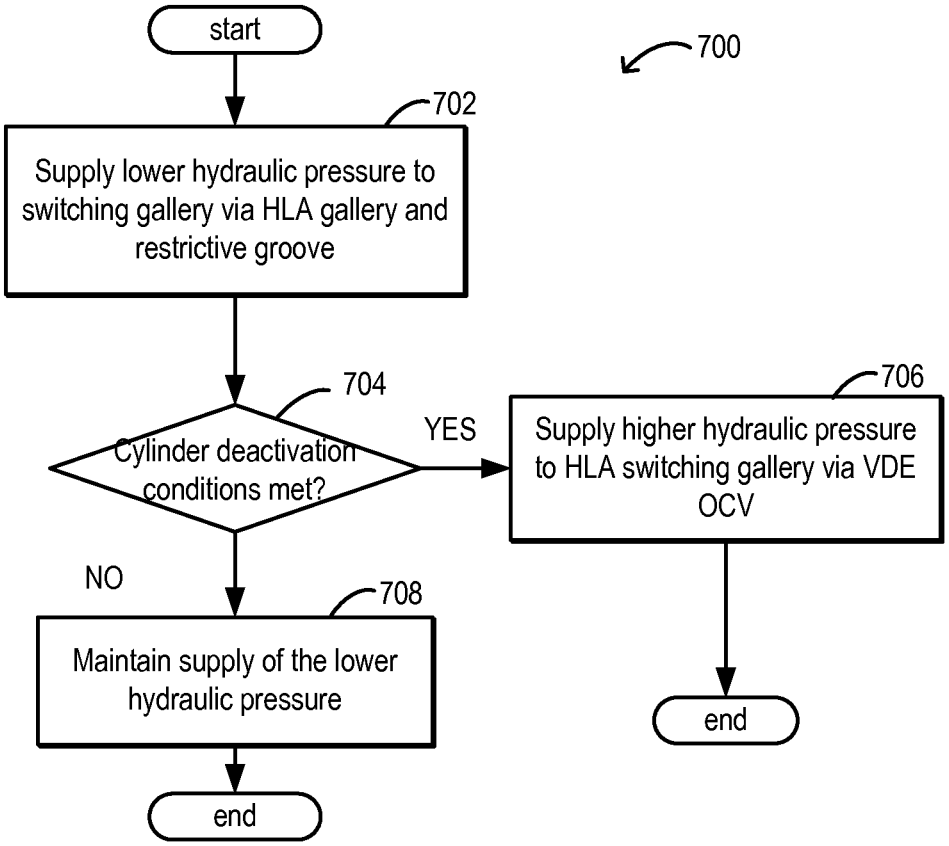
FIG. 7 shows an example method for activating and deactivating a VDE cylinder that is integrated into the hydraulic circuit of the present invention.

The following description relates to systems and methods for deactivating rocker arms for VDE cylinders of an engine. The engine, shown in an exploded view at FIG. 1, includes a hydraulic circuit for activating and deactivating the VDE cylinders. Whether the VDE cylinders are activated or deactivated depends on whether a poppet valve deactivation control valve (herein also termed a variable displacement engine oil control valve or VDE OCV) is in a de-energized state or energized state, respectively. FIGS. 2A and 2B show schematic views of the hydraulic circuit wherein the deactivation control valve in respective de-energized and energized states, indicating the direction of hydraulic flow throughout the various fluid passages of the circuit. The hydraulic circuit includes a hydraulic flow restrictor to provide hydraulic fluid to a switching portion of the circuit when the valve deactivation control valve is in the de-energized state. The hydraulic flow restrictor is machined into the bottom surface of a camshaft carrier of the engine, and generally comprises of two vertical bores coupled via a horizontal restrictive groove. FIG. 3 shows a first embodiment of a hydraulic flow restrictor within the hydraulic circuit, while FIG. 4 shows of second embodiment of the hydraulic flow restrictor. FIGS. 5 and 6 show the connectivity of two fluid passages to the first and second vertical bores of the hydraulic flow restrictor. FIG. 7 provides a method for operating the hydraulic circuit of the present invention.

Figure 1:
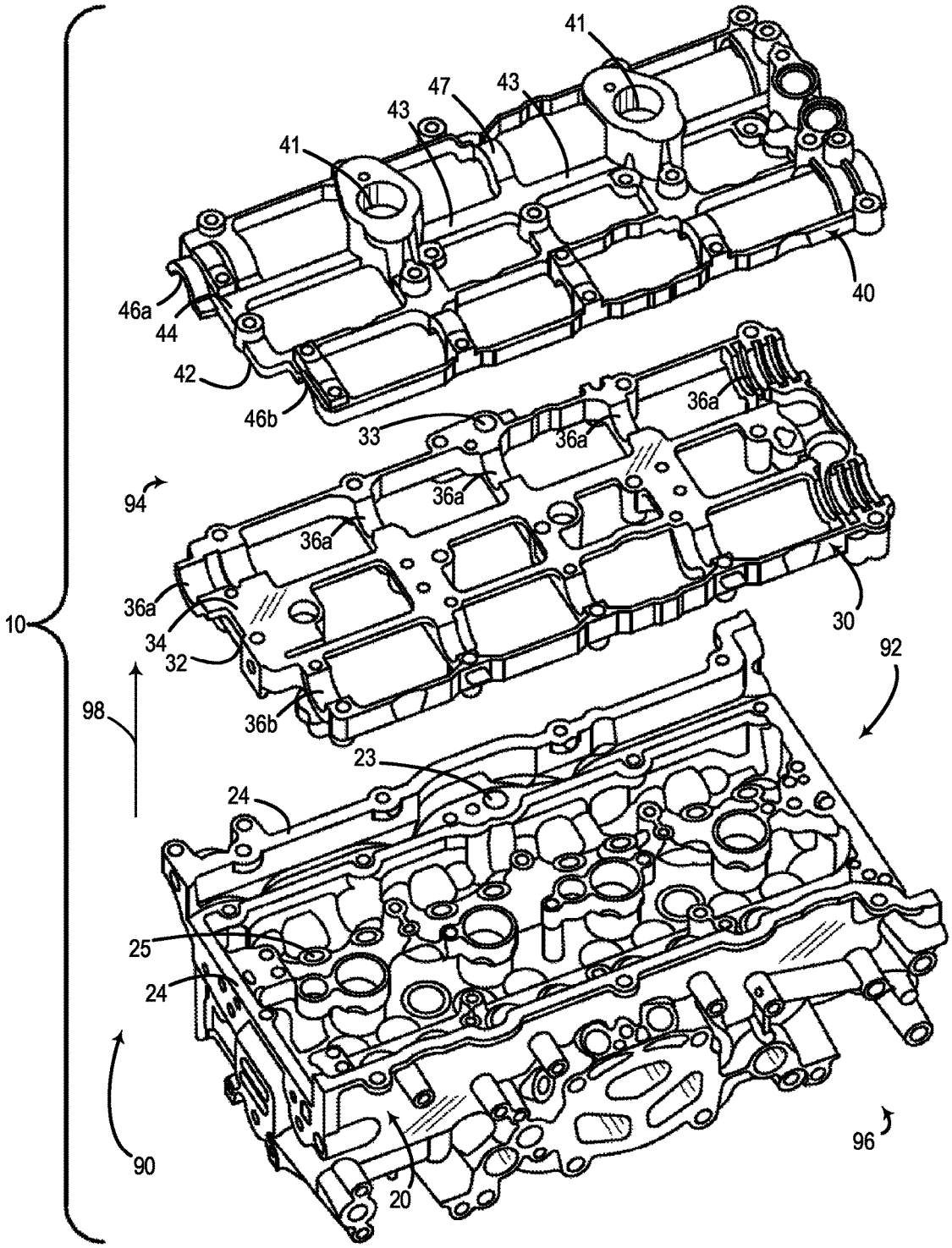
FIG. 1 exploded view of an engine block, including a camshaft carrier configured to rest atop a cylinder head.

Turning now to FIG. 1, it shows an exploded view of an engine block 10. Specifically, the exploded view stratifies cylinder head 20, camshaft carrier 30, and carrier cover 40 in a vertical direction. Arrow 98 is provided to indicate the vertical direction. Specifically, arrow 98 represents a direction that is normal to a flat ground upon which a vehicle comprising engine block 10 may be resting when said vehicle is configured to drive. Accordingly, a "top" end or face of any component composing engine block 10 is the end or surface positioned at the vertical apex of the component, and the "bottom" face of the component is located at the end opposite the top face.

Engine block 10 includes a first axial end 90 and a second axial end 92. The term axial refers to the direction of extension of camshafts (not shown) that may be included within the engine block. It will be appreciated that the axial direction is perpendicular to the vertical direction 98 (e.g., it extends within the horizontal plane). As one example, when engine block 10 is configured within an engine compartment of a vehicle, first axial end 90 may be situated toward the front end of the compartment (e.g., facing the direction of forward motion), and second axial end 92 may be situated toward the rear end of the engine compartment. As another example, such as in a north/south configuration, second axial end 92 may be situated toward the front end of the engine compartment, and first axial end 90 may be situated toward the rear end of the compartment.

Engine block 10 further includes a first lateral end 94 and a second lateral end 96. It will be appreciated that the lateral direction is perpendicular to each of the vertical direction and the axial direction. As one example, with reference to the front end 90 and rear end 92, first lateral end 94 is a left end and second lateral end 96 is a right end. Put another way, the axial direction refers to the horizontal axis along which a camshaft may be configured to rest within camshaft carrier 30 (as evidenced by the cylindrical cutout below the VCT OCV), and the lateral direction refers to the horizontal axis perpendicular to the axial direction. As one example, first lateral end 94 may be associated with a set of intake components for a plurality of combustion chambers, and second lateral end 96 may be associated with a set of exhaust components, or vice versa.

Cylinder head 20 includes a plurality of combustion chambers therein (not shown). The intake and outlet ports for said combustion chambers are also housed therein. Opening and closing the intake and outlet ports is controlled by the position of a plurality of poppet valves, and said poppet valves are configured to be housed within a plurality of bores 25. Vertical bore 23 is fluidly coupled to an oil pump and is configured to deliver hydraulic fluid from an oil sump to an oil control valve, as described in further detail with reference to FIGS. 2A and 2B. The top face 24 of the cylinder head is configured to be flushly adjacent to the bottom face 42 of carrier cover 40 when the engine block is assembled. Similarly, cylinder head surface 26 is configured to be flushly adjacent with bottom face 32 of camshaft carrier 30 when the engine block is assembled.

Camshaft carrier 30 is configured to rest atop cylinder head 20 when engine block 10 is assembled. Camshaft carrier 30 includes a bottom face 32 and a top face 34. Top face 34 is configured to be in face-sharing contact with bottom face 42 of carrier cover 40. The bottom face 32 may include a plurality of features designed to restrict the flow of fluid within a valve deactivation hydraulic circuit, as described below.

A vertical bore 33 extends through the entire vertical extent of camshaft carrier 30 and may be configured to provide oil from bore 23 to the carrier cover 40 when engine block 10 is assembled. In this way, oil from an oil sump may be delivered to a poppet valve deactivation control valve housed at carrier cover 40 via an oil gallery extending through each of cylinder head 20, camshaft carrier 30, and carrier cover 40 (e.g., oil gallery 203 at FIGS. 2A and 2B).

A plurality of semicircular recesses **36*a* and 36*b* are configured to hold two camshafts that include a plurality of cams for actuating the poppet valves of the engine. The semicircular recesses 36*a* are axially aligned at a first lateral end 94 of camshaft carrier 30, and recesses 36*b* are axially aligned at a second lateral end 96 of the camshaft carrier 30. It will be appreciated that recesses 36*a* may hold a camshaft with cams that actuate a plurality of intake valves within cylinder head 20, and recesses 36*b* may hold a camshaft with cams that actuate a plurality of exhaust valves within cylinder head 20. That is to say, the intake side of the valve actuation mechanisms are axially aligned along a first lateral end of the cylinder head 20, and the exhaust side of the valve actuation mechanism are axially aligned along a second lateral end of the cylinder head 20**.

Carrier cover 40 is configured to rest atop camshaft carrier 30. The bottom face 42 includes a plurality of the semicircular recesses 46*a* and 46*b* which are aligned to cover camshafts held in respective recesses 36*a* and 36*b*. Carrier cover 40 further includes two control valve bores 41. Bores 41 are each configured to house a poppet valve deactivation control valve that are in fluidic communication with the valve actuation mechanisms of cylinder head 20. This fluidic communication is described in further detail below, with reference to FIGS. 2A and 2B. Hydraulic fluid may be delivered to bores 41 via gallery 43 (within the carrier cover). Gallery 43 may receive oil from an oil sump via vertical bores 33 and 23. As one example, vertical bore 33 may feed hydraulic fluid to cam journal bore 47, which may in turn route said hydraulic fluid to gallery 43.

When engine block 10 is assembled, the surface 26 of cylinder head 20 is configured to be flushly adjacent with the bottom face 32 of carrier cover 30. Similarly, the top face 34 of camshaft carrier 30 is configured to be flushly adjacent to the bottom face 42 of carrier cover 40. In this way, a first bore extending into a top face of a first engine block component may be fluidically coupled to a second bore extending into a bottom face of a second component if said bores are both axially and laterally aligned. For example, a first bore 23 of an oil pump gallery may be fluidly coupled to a second bore 33 of the oil pump gallery when the engine block 10 is assembled.

A plurality of fluidic passages within each of cylinder head 20, camshaft carrier 30, and carrier cover 40 may be configured to provide hydraulic fluid to valve actuation components within cylinder head 20. Specifically a hydraulic circuit may be formed within engine block 10 for activating a plurality of VDE cylinders within cylinder head 20. A schematic view of this hydraulic circuit is provided at FIGS. 2A and 2B (e.g., hydraulic circuit 200), and structural views of portions of the circuit are shown at FIGS. 3-6. It will be appreciated that FIGS. 3-6 provide different views of engine block 10, and for this reason may include reference characters introduced at FIG. 1 to indicate like components.

Turning now to FIGS. 2A and 2B, a hydraulic circuit 200 for operating the actuation components of a plurality of combustion cylinders 230 and 260 is shown. Hydraulic circuit 200 includes a number of de-activatable VDE cylinders 230, and the circuit includes a VDE oil control valve 210 for each VDE cylinder 230. Hydraulic circuit 200 may operate each VDE oil control valve 210 in one of a de-energized or an energized state to operate each corresponding VDE cylinder 230 in an activated mode or a de-activated mode, respectively. Specifically, FIG. 2A shows each VDE OCV 210 in a de-energized state, while FIG. 2B shows each VDE OCV 210 in an energized state. In this example, the hydraulic fluid within the circuit may be oil, and any references herein to oil pressure are non-limiting examples of a hydraulic pressure.

Hydraulic circuit 200 includes a first end 290 and a second end 292. First end 290 and second end 292 provide a relative orientation of components within the circuit. Specifically, first end 290 refers to the end of the hydraulic circuit adjacent to a first axial end of one of camshafts 294*a* or 294*b*, and second end 292 refers to the end of the hydraulic circuit adjacent to the second axial end of said camshaft. As one example, the plurality of cylinders 230 and 260 may be arranged within an engine compartment so that the first end 290 is the front-facing end of the engine compartment, and second end 292 is the rear-facing end of the engine compartment. As other examples, first end 290 and second end 292 may respectively be a left side and right side of an engine compartment, or vice versa. It will be appreciated that the axial extents of camshafts 294*a* and 294*b* are along parallel axes.

Regarding identical components shown at FIG. 2, a number of reference characters have been omitted. Additionally, the reference characters of identical components on the intake side of the cylinders may include a suffix different than those on the exhaust side of the cylinders for reasons of clarity (e.g., DHLAs 232*a* and 232*b*). However, a component of hydraulic circuit 200 may be referred to herein with the suffix is omitted when describing features that do not vary based on the location of the component, or alternatively when referring to said component collectively (e.g., a DHLA 232 or DHLAs 232).

Hydraulic circuit 200 provides hydraulic pressure to a plurality of valve actuation components, including a first number of dual-function hydraulic lash adjusters (DHLAs) 232 and a second number of hydraulic lash adjusters (HLAs) 262. The DHLAs 232 and HLAs 262, in combination with corresponding switchable roller finger followers (SRFFs), rolling finger followers (RFFs, not shown), and cams (not shown) on camshafts 294*a* and 294*b*, are configured to actuate intake and exhaust valves of the combustion cylinders. One DHLA and SRFF is provided for each intake and exhaust valve of a VDE cylinder 230, while one HLA and one RFF is provided for each intake and exhaust valve of a cylinder 260.

The depicted example includes two intake valves and two exhaust valves for four cylinders, wherein the four cylinders include two de-activatable VDE cylinders 230. Thus, as depicted, hydraulic circuit 200 may be for an engine with an 1-4 cylinder configuration, or alternatively may be for one bank of cylinders of a V-8 cylinder arrangement. It will be appreciated, however, that the features of the present invention may be included in engines with alternate valve and cylinder configurations, such as cylinders with only one intake valve and one exhaust valve, and cylinder configurations such as V-4, V-6, I-5, I-3, etc.

Each DHLA 232 is physically and fluidically coupled to a corresponding switching roller finger follower, while each HLA is physically coupled to a corresponding rolling finger follower. It will be appreciated that while DHLAs 232 and HLAs 262 may each provide lash compensation to their corresponding SRFFs and RFFs via a physical coupling, each DHLA 232 may switch the SRFF between a latched mode and an unlatched mode via the fluidic coupling. The rolling finger followers lack a switching mechanism, and as such, each HLA 262 may provide only lash compensation to a corresponding RFF.

Each DHLA 232 and each HLA 262 includes a lash compensation port 218, and each DHLA 232 further includes a switching port 220. Each lash compensation port 218 is directly coupled to one of HLA galleries 212*a* or 212*b*, while each switching port 220 is directly coupled to an axial passage 216*a* or 216*b* of switching gallery 214. A switching gallery is provided for each VDE cylinder 230 and is fluidly coupled to the switching port 220 of each DHLA 232 corresponding to said VDE cylinder 230. That is to say, the DHLAs 232 corresponding to each intake valve and each exhaust valve of a common VDE cylinder 230 are each fluidically coupled to a common switching gallery 214, as described further below.

Each DHLA 232 may be configured to provide hydraulic fluid to a latch pin hydraulic chamber 222 of a corresponding SRFF. The DHLA may provide the latch pin hydraulic chamber 222 with hydraulic fluid at a first, lower amount of pressure from switching gallery 214 when the VDE OCV

210 is in the de-energized state, and may provide the latch pin hydraulic chamber 222 with hydraulic fluid at a second, higher amount of pressure via switching gallery 214 when VDE OCV is in the energized state. As one example, the DHLA may provide the hydraulic fluid via a switching port 220 and a DHLA switching gallery that fluidly couples the switching port 220 to the latch pin hydraulic chamber 222. It will be appreciated that the supply of oil to each lash compensation port 218 via HLA gallery 212 does not vary based on the state of either VDE OCV 210.

In some examples, dual-function hydraulic lash adjusters 232 may instead be deactivatable hydraulic lash adjusters. In such examples, the second port 220 may be configured to switch the lash adjuster into a collapsed state, rather than being configured to provide hydraulic fluid to a switching mechanism within the switching roller finger follower. In such examples, chambers 222 may comprise a switching chamber within the DHLA 232 rather than within a SRFF.

Oil pump 202 provides oil to each VDE OCV 210 via gallery 203, to VCT oil control valves 208*a* and 208*b*, and to HLA bore restrictors 298*a* and 298*b*. Relative to the cylinder bank, each VCT OCV 208 and HLA bore restrictor 298 is positioned toward first end 290 of the hydraulic circuit. It will be appreciated that while oil pump 202 is shown as a single pump at FIG. 2, in other examples a more complex hydraulic circuit comprising a plurality of pumps and passages may be configured to supply VCT OCVs 208, VDE OCVs 210, and HLA bore restrictors 298 with oil at desired amounts of pressure. It will be further appreciated that oil pump 202 may provide oil to other components of the engine at various pressures, and only components relevant to the present invention are described herein.

Two VCT OCVs 208*a* and 208*b* are provided to route oil to respective VCT actuators (not shown) that are bolted on to respective camshafts 294*a* and 294*b*. Each VCT OCV 208 is controlled by a vehicle controller based on desired cam timings and may also include a drain path to an oil sump (not shown).

Two HLA bore restrictors 298*a* and 298*b* are configured to provide restricted hydraulic flows to respective HLA galleries 212*a* and 212*b*. In one example, each HLA bore restrictor 298 may be configured to provide a hydraulic flow to a respective HLA gallery 212 at a pressure within a range of 0.5 bar to 2 bar. Each HLA gallery 212 may comprise an axial bore drilled within the cylinder head of an engine, as described in further detail below. Hydraulic fluid within an HLA gallery 212 is configured to flow from the first end 290 toward the second end 292 of the hydraulic circuit 200. Further, the HLA bore restrictor 298 is at the upstream-most position of the HLA gallery.

Each HLA gallery 212 is fluidically coupled to the plurality of DHLAs 232 and the plurality of HLAs 262 via lash compensation ports 218, and may thereby provide each dual-function HLA 232 and each HLA 262 with hydraulic fluid at a desired pressure for lash compensation.

Downstream of the plurality of lash compensation ports 218, each HLA gallery 212 leads to a tappet bore of a fuel pump (not shown), as indicated at 299. The fuel pump tappet bore feed may be highly restricted via a tight annular clearance between the fuel pump tappet and the tappet bore.

Each HLA gallery 212*a* and 212*b* is also directly coupled to a number of respective deactivation restrictors 280*a* and 280*b* via respective HLA gallery branches 213*a* and 213*b*. As one example, HLA gallery branches 213*a* and 213*b* may comprise a plurality of bores and grooves in each of the cylinder head and a bottom face of a camshaft carrier, and may fluidically couple HLA galleries 212*a* and 212*b* to respective deactivation restrictors 280*a* and 280*b*. HLA gallery branches 213*a* and 213*b* differ from HLA galleries 212*a* and 212*b* in that the latter pair may each comprise an axial bore within the cylinder head, whereas the former pair may comprise fluidic passages extending in a number of directions, and machined within each of the cylinder head and the camshaft carrier. By including branches 213*a* and 213*b* from the axial bores of HLA galleries 212*a* and 212*b*, the HLA galleries may be fluidically coupled to deactivation restrictors 280*a* and 280*b* when the deactivation restrictors are machined into the bottom face of the camshaft carrier. Each HLA gallery is coupled to a number of deactivation restrictors that is equal to the number of VDE cylinders 230 in the bank of cylinders.

Deactivation restrictors 280*a* and 280*b* couple each HLA gallery 212*a* and 212*b* to a switching gallery 214. It will be appreciated that deactivation restrictors 280 restrict hydraulic flow by a greater amount than HLA bore restrictors 298. Each switching gallery 214 of hydraulic circuit 200 includes a first axial passage 216*a* and a second axial passage 216*b*, and further includes a first restrictor branch 215*a* and a second restrictor branch 215*b*. First restrictor branch 215*a* is a direct extension of first axial passage 216*a*, and second restrictor branch 215*b* is a direct extension of second axial passage 216*b*. Restrictor branches 215*a* and 215*b* of switching gallery 214 differ from axial passages 214*a* and 214*b* of switching gallery 214 in that the latter pair may each comprise an axial bore within the cylinder head, whereas the former pair may comprise fluidic passages extending in a number of directions, and machined within each of the cylinder head and the camshaft carrier. By including branches 215*a* and 215*b* from the axial passages of switching galleries 214, the switching galleries may be fluidically coupled to deactivation restrictors 280*a* and 280*b* when the deactivation restrictors are machined into the bottom face of the camshaft carrier.

It will be appreciated that each HLA gallery 212*a* and 212*b* is coupled to a distinct plurality of deactivation restrictors 280*a* and 280*b*, and that no deactivation restrictor 280 is directly coupled to more than one HLA gallery 212 or to more than one switching gallery 214. By coupling the deactivation restrictor 280 to a terminal end of switching gallery 214, hydraulic fluid and air within any portion of switching gallery 214 may be promoted to flow toward the pressure relief valve 244 within VDE OCV 210. In this way, any portion of switching gallery 214 may continually expel entrapped air from the hydraulic circuit to an oil sump.

Each deactivation restrictor 280 comprises a main filter bore 284, a switching filter bore 286, and a restrictive groove 282 coupling the first and second vertical bores. Each of filter bores 284 and 286 and restrictive groove 282 may be integral to the cam carrier of the engine (e.g., drilled in during the manufacturing of the cam carrier). Each of main filter bore 284 and switching filter bore 286 may include filters situated flushly therein for removing debris from hydraulic fluid traveling therethrough.

The main filter bore 284 is directly coupled to HLA gallery 212 via HLA gallery branch 213, while the switching filter bore 286 is directly coupled to switching gallery 214 at one end of restrictor branch 215. Thus, deactivating restrictor 280 couples HLA gallery 212 to switching gallery 214. When the hydraulic pressure in HLA gallery 212 is greater than the hydraulic pressure in switching gallery 214, deactivating restrictor 280 may provide a restricted flow of hydraulic fluid from HLA gallery 212 to switching gallery 214. Conversely, a pressure differential across restrictor 280 may promote a restricted amount of flow from switching gallery 214 to HLA gallery 212 when the pressure within switching gallery 214 is greater than the pressure within HLA gallery 212. However, in other examples, such as when hydraulic pressures in HLA gallery 212 and switching gallery 214 are substantially similar to one another (e.g., within 0.5 bar), hydraulic flow restrictor 280 may not substantially affect the flow in either HLA gallery 212 or switching gallery 214. By providing a restrictor that is integral to the engine block and/or cylinder head, costs may be improved compared to incorporating an external restrictor into a hydraulic channel of hydraulic circuit 200.

VDE OCV 210 may be a solenoid valve that is configured to selectively provide a high oil pressure to the switching ports 220 of each DHLA 232 that corresponds to a single VDE cylinder 230. Each switching gallery 214 couples a VDE OCV 210 to two deactivating restrictors 280*a* and 280*b*. Each axial passage 216*a* and 216*b* of the switching gallery 214 is directly coupled to a number of switching ports 220*a* and 220*b* at a location between a respective deactivating restrictor 280*a* and 280*b* and VDE OCV 210. Thus, switching gallery 214 fluidly couples VDE OCV 210 to each switching port 220 of the DHLAs 232 corresponding to a common VDE cylinder 230.

Each VDE OCV 210 includes a switch 217 for selectively providing switching gallery 214 with oil from gallery 203. As described in further detail below, when switch 217 is in a first position, hydraulic fluid from oil pump 202 may travel through VDE OCV 210 via gallery 203 and into switching gallery 214, which may deliver the oil to switching ports 220. When switch 217 is in a second position, oil from oil pump 202 may be prevented from flowing through VDE OCV 210 via gallery 203. Controlling switch 217 in one of a first or second position may correspond to operating VDE OCV 210 in one of the energized or de-energized states, accordingly.

Each VDE OCV 210 may include a pressure relief valve 244 which may be configured to release air and oil to an oil sump when VDE OCV 210 is de-energized, and may be sealed from releasing any fluids to the oil sump when VDE OCV 210 is energized. As one example, the pressure relief valve may be configured to release pressure at a threshold pressure greater than the pressure supplied to the switching gallery when the VDE OCV is in the de-energized state. When in the de-energized state, pressure relief valve 244 may receive a flow of oil from switching gallery 214, as discussed in further detail below.

FIGS. 2A and 2B share identical components, however at least a portion of the fluidic connectivities between said components may differ between each figure based on whether VDE OCV 210 is energized or de-energized. Switching gallery 214 is configured hydraulically in series between a deactivation restrictor 280 and VDE OCV 210. Relative to deactivation restrictor 280, switching ports 220 are positioned hydraulically in parallel with VDE OCV 210. Specifically, hydraulic fluid may be configured to flow from restrictor 280 to gallery 215*a* (in series), then in parallel to either a first switching port 220, a second switching port 220, or to VDE OCV 210 via gallery 216*a*. During some conditions, such as when each DHLA is in a primed or de-aerated and partially pressurized state, each switching port 220 may function as a hydraulic or piezometric head for oil flow, thereby continually promoting hydraulic flow away from the DHLAs and toward VDE OCV 210.

It will be appreciated that the directionality of oil flow through several key components, including switching gallery 214, may be reversed from FIG. 2A to FIG. 2B. Thus it will be appreciated that the relative positioning of at least deactivation restrictor 280, switching ports 220, and VDE OCV 210 (e.g., upstream or downstream from one another) may differ based on whether VDE OCV 210 is in the energized or the de-energized state.

Switching gallery 214 may provide a first, lower amount of pressure to the switching port 220 of each DHLA when the VDE OCV 210 is in the de-energized state, and may provide a second, higher amount of pressure to the switching ports 220 of each DHLA 232 when the VDE OCV is in the energized state. In the de-energized state, hydraulic fluid within each HLA gallery 212 enters switching gallery 214 at the first, lower amount of pressure via deactivating restrictors 280, as described in further detail with reference to FIG. 2A. This restricted hydraulic flow is delivered to each of switching ports 220 and VDE OCV 210 of a common VDE cylinder. In the energized state of the VDE OCV, switching gallery 214 is provided with the second, higher amount of pressure via the VDE OCV switch 217, as described in further detail with reference to FIG. 2B.

Control system 14 includes a plurality of sensors 16, a controller 12, and a plurality of actuators 81. The controller 12 receives signals from the various sensors of FIG. 2 and employs the various actuators of FIG. 2 to adjust engine operation based on the received signals and instructions stored on a memory of the controller. For example, controller 12 may employ VDE OCV 210 to deactivate VDE cylinders 230 when the sensors signal that deactivation conditions are present.

Turning now to FIG. 2A, an example hydraulic circuit 200 for valve deactivation, including two VDE OCVs 210, is shown operating in a first mode. Specifically, FIG. 2A depicts hydraulic circuit 200 with each VDE OCV 210 operating in the de-energized state so that the switching roller finger followers are in a latched mode, thereby actuating corresponding poppet valves of a VDE cylinder. It will be appreciated that when VDE OCV 210 is in the de-energized state, the corresponding switch 217 is switched to the second position and the VDE OCV 210 is not configured to deliver a high hydraulic pressure from gallery 203 to switching gallery 214.

When each VDE OCV 210 is in the de-energized state, each HLA gallery 212 supplies restricted amounts of flow at a lower pressure to switching galleries 214 via deactivation restrictors 280 (as indicated by the dashed lines extending from each deactivation restrictor 280). Specifically, a first HLA gallery 212 supplies restricted amount of flow at the lower hydraulic pressure to first branches 214*a* of each switching gallery, and a second HLA gallery 212 supplies restricted amounts of flow at the lower hydraulic pressure to second branches 214*b* of each switching gallery. As one example, the pressure of hydraulic fluid entering each deactivation restrictor 280 at main filter bore 284 may be in the range of 0.5 to 2 bar, while the pressure of restricted hydraulic fluid supplied to switching gallery 214 via restrictive groove 282 and switching filter bore 286 may be in the range of 0.1 to 0.5 bar. The restricted hydraulic flow travels through switching gallery 214 toward pressure relief valve 244 within VDE OCV 210. It will be appreciated that the flow of hydraulic fluid from switching gallery 214 towards VDE OCV 210 may be promoted via one or more of the pressure differential across the deactivation restrictor 280 and the pressure difference across pressure relief valve 244.

When VDE OCV 210 is de-energized, the flow through each axial passage 216*a* and 216*b* of switching gallery 214 begins at the coupling to deactivation restrictor 280, travels past the couplings to switching ports 220, and terminates at pressure relief valve 244. Pressure relief valve 244 may be configured to release pressure into an oil sump when VDE OCV 210 is de-energized and pressure within switching gallery 214 is above a threshold pressure, as indicated by arrow 245. The threshold pressure may be based on pressure relief valve characteristics. In one example, the threshold pressure is the pressure of the restricted hydraulic flow provided to switching gallery 214 by deactivation restrictor 280, and pressure relief valve 244 may thereby maintain switching gallery 214 at the pressure of the restricted flow when VDE OCV 210 is de-energized.

In some examples, when VDE OCV 210 is de-energized, pockets of air may be present within one or more axial passages 216*a* and 216*b* of switching gallery 214, one or more DHLA 232, one or more corresponding SRFF, and/or a combination thereof. By promoting a restricted flow of hydraulic fluid from each deactivation restrictor 280, through switching gallery 214, and toward pressure relief valve 244, pockets of air within the switching gallery, dual-function HLAs 232, or corresponding switching rolling finger followers (not shown) may be captured along with the restricted hydraulic flow and released to an oil sump via pressure relief valve 244. Furthermore, by positioning the source of this hydraulic flow at a position along each switching gallery branch that is upstream of all valve deactivation components, air may be purged from the components in addition to the switching gallery itself. Thus, by providing restricted hydraulic flows to switching gallery 214 via deactivation restrictors 280, air may be purged from the hydraulic channels and chambers of a number of valve deactivation components when VDE OCV 210 is de-energized. In this way, hydraulic response times may be improved upon switching VDE OCV 210 from the de-energized state to the energized state.

Turning now to FIG. 2B, it shows hydraulic circuit 200 with VDE OCV 210 in an energized state. When VDE OCV 210 is in the energized state, switch 217 is in the first position and VDE OCV 210 provides a hydraulic flow at a second hydraulic pressure from gallery 203 to switching gallery 214. As one example, the second hydraulic pressure may be within a range of 2 to 4 bar. It will be appreciated that the second hydraulic pressure is greater than the first hydraulic pressure provided to switching gallery 214 via the restricted flow from deactivation restrictor 280 during de-energized VDE OCV conditions. Further, when VDE OCV 210 is in the energized state, pressure relief valve 244 is closed and does not release any pressure to the oil sump. Thus arrow 245 of FIG. 2A is omitted at FIG. 2B, and hydraulic fluid is configured to flow away from VDE OCV 210 in the energized state, rather than toward VDE OCV 210 as in the de-energized state.

The hydraulic fluid at the second pressure may flow from VDE OCV 210 toward deactivation restrictors 280 via switching gallery 214, and may be provided to switching ports 220 of each dual-function HLA 232 at the first and second axial passages 216*a* and 216*b* of the switching gallery. In this way, when VDE OCV 210 is in an energized state, each dual-function HLA 232 may be configured to provide a respective SRFF with a second, higher amount of pressure to maintain the SRFF in an unlatched mode. Thus the energized state of VDE OCV 210 corresponds to a deactivated state of a VDE cylinder.

The flow of hydraulic fluid within switching gallery 214 at FIG. 2B is such that VDE OCV 210 is upstream of each switching port 220 and each deactivation restrictor 280. Switching gallery 214 is upstream of and directly coupled to switching filter bore 286 of deactivation restrictor 280. Main filter bore 284 of deactivation restrictor 280 is provided an amount of hydraulic pressure from HLA gallery 212, and this hydraulic pressure may be substantially similar to the second, higher pressure provided to switching gallery 214 via VDE OCV 210. In this way, when VDE OCV 210 is in an energized state, flow from switching gallery 214 through deactivation restrictor 280 and to HLA gallery 212 may be reduced by the balanced pressures on each side of restrictive groove 282. In one example, a reduced flow from the switching gallery 214 to the HLA gallery 212 may include an absence of flow. However, in other examples, a reduced flow from the switching gallery 214 to the HLA gallery 212 may include an amount of flow that is greater than zero but less than the reverse flow during de-energized VDE OCV conditions described above.

It will be noted that upon switching VDE OCV 210 from the de-energized state to the energized state, the direction of flow within switching gallery 214 is reversed. Put another way, the priming of the SRFFs is achieved by a reverse flow within switching gallery 214 when compared to the flow within switching gallery 214 during the deactivated state of the VDE cylinders.

Thus, in a first state of operation, hydraulic circuit 200 may passively control the pressure of hydraulic fluid within each switching gallery 214 at a first, lower pressure via two deactivation restrictors 280*a* and 280*b* incorporated into the cylinder head and an open pressure relief valve 244 within a VDE OCV. In a second state of operation, hydraulic circuit 200 may actively control the pressure of hydraulic fluid within each switching gallery 214 at a second, higher pressure via each of an energized VDE OCV 210 including a closed pressure relief valve 244 and a balancing of pressures across the deactivation restrictors 280.

Turning now to FIG. 3, it shows a first deactivation restrictor embodiment 380 incorporated into a bottom face 32 of a camshaft carrier 30. First end 90 and second end 92 of camshaft carrier 30 indicate two ends of the axial direction of the camshaft carrier, as described above with reference to FIGS. 1 and 2. Additionally, as indicated by arrow 98, the upward direction extends substantially into the page at FIG. 3. Deactivation restrictor 380 may be on either of the intake or exhaust side of a camshaft carrier (e.g., either one of deactivation restrictors 280*a* or 280*b* at FIGS. 2A and 2B). Correspondingly, the portion of switching gallery restrictor branch 315 shown at FIG. 3 may be an exhaust-side branch or an intake-side branch of the switching gallery (such as one of branches 215*a* or 215*b* at FIGS. 2A and 2B).

HLA gallery branch 313 is coupled to first vertical bore 384 via a first cross drill 381. It will be understood that while the first portion of HLA gallery branch 313 may comprise a groove extending along the bottom face 32 of the camshaft carrier 30 (e.g., as shown at FIG. 3), a remainder portion of HLA gallery branch 313 may comprise a vertical drilling extending into a cylinder head, for example. It will be appreciated that said first and remainder portions of HLA gallery branch 313 are in direct communication with one another and comprise an unobstructed fluidic passage when the camshaft carrier 30 and the cylinder head are in face-sharing contact (e.g., when engine 10 at FIG. 1 is assembled).

First cross drill 381 provides a direct coupling of HLA gallery branch 313 and first vertical bore 384. Specifically, first cross drill 381 extends from HLA gallery branch 313 to an opening 383 along the outer radius of first vertical bore 384. In this way, first cross drill 381 may provide hydraulic fluid from HLA gallery branch 313 to first vertical bore 384, or vice versa. First cross drill 381 may comprise a single drilling in camshaft carrier 30 extending from HLA gallery branch 313 to the outer radius of vertical bore 384. The drilling may be along a radially outward direction of first vertical bore 384. First cross drill 381 may be of a lesser hydraulic diameter than each of HLA gallery branch 313 and first vertical bore 384.

First vertical bore 384 directly couples first cross drill 381 to restrictive groove 382. First vertical bore may comprise a bore within camshaft carrier 30 extending from a bottom face 32 of toward a top end of camshaft carrier 30 (e.g., extending upward from the bottom face 32 when camshaft carrier 30 is installed in a vehicle). It will be appreciated that the vertical extent of first vertical bore 384 is less than the vertical extent of the camshaft carrier 30 (e.g., first vertical bore 384 may not fully span the vertical extent of the camshaft carrier 30). First vertical bore 384 may be configured to house an oil filter (not shown). Said oil filter may be of the same outer diameter as vertical bore 384, thereby flushly fitting within vertical bore 384. The oil filter may be an interchangeable component that may be replaced when degradation of the filter is detected. In this way, any hydraulic fluid that may pass through restrictive groove 382 via the filter housed in vertical bore 384 may include less particulate matter, thereby reducing degradation of the restrictive groove.

Restrictive groove 382 is a groove that may be machined into the bottom face 32 of camshaft carrier 30, and may extend horizontally from first vertical bore 384 to second vertical bore 386. Restrictive groove 382 directly couples a bottom end of first vertical bore 384 to a bottom end of second vertical bore 386. Additionally, restrictive groove 382 is configured to restrict the flow of hydraulic fluid passing from first vertical bore 384 to second vertical bore 386, or vice versa. Restrictive groove may be of a lesser hydraulic diameter or a lesser cross-sectional area than each of HLA gallery branch 313, first and second cross drills 381 and 387, first and second vertical bores 384 and 386, and switching gallery restrictor branch 315. It will be understood that a hydraulic diameter refers to a parameter relating a flow passage of an arbitrary shape to a diameter of a cylindrical or tubular flow passage (e.g., a passage with a constant circular cross-sectional area throughout). In this way, a restricting of hydraulic flow across the restrictive groove may be more reliable.

Second vertical bore 386 is directly coupled to restrictive groove 382, and is directly coupled to second cross drill 387 via an opening 385 along the outer diameter of the vertical bore. Second vertical bore 386 may be similar to first vertical bore 384, insofar as it may comprise a bore within camshaft carrier 30 extending from a bottom face 32 of toward a top end of camshaft carrier 30 (e.g., vertically upward when camshaft carrier is installed in a vehicle). Second vertical bore 386 may be configured to house an oil filter (not shown). Said oil filter may be of the same outer diameter as vertical bore 386, thereby flushly fitting within vertical bore 384. The oil filter may be an interchangeable component that may be replaced when degradation of the filter is detected. In this way, any hydraulic fluid that may flow through restrictive groove 382 via the filter housed in vertical bore 386 may contain a reduced amount of particulate matter, thereby reducing degradation of the restrictive groove.

Second cross drill 387 provides a direct coupling of switching gallery restrictor branch 315 and second vertical bore 386. Specifically, second cross drill 387 extends from switching gallery restrictor branch 315 to an opening 385 along the outer radius of second vertical bore 386. Second cross drill 387 may comprise a single drilling in the camshaft carrier extending from restrictor branch 315 to the outer radius of vertical bore 386. The drilling may be along a radially outward direction of first vertical bore 386. Second cross drill 387 may be of a lesser hydraulic diameter than each of switching gallery restrictor branch 315 and second vertical bore 386.

Switching gallery restrictor branch 315 is coupled to second vertical bore 386 via a first cross drill 387. While a first portion of switching gallery restrictor branch 315 a remainder portion of the restrictor branch 315 may comprise a groove extending along the bottom face 32 of the camshaft carrier 30, may be a bore within the cylinder head that is directly coupled to an axial passage of the switching gallery (e.g., as shown at FIG. 5), as depicted at FIG. 3. It will be appreciated that said first and second portions of switching gallery restrictor branch 315 are in direct communication with one another and comprise a single fluidic passage when the camshaft carrier and the cylinder head are in face-sharing contact (e.g., when engine 10 at FIG. 1 is assembled). As described above with reference to FIGS. 2A and 2B, switching gallery restrictor branch 315 may be directly coupled to one end of an axial passage of the switching gallery, and said axial passage may be further coupled to a plurality of valve deactivation components. Thus, during some conditions, switching gallery restrictor branch 315 may deliver a restricted flow of hydraulic fluid from restrictive groove 382 to said deactivation components. During other conditions, switching gallery restrictor branch 315 may provide an unrestricted flow from a valve deactivation control valve to restrictive groove 382.

By including a hydraulic restriction comprising a plurality of fluidly coupled drillings and bores within camshaft carrier 30, a hydraulic restriction between an HLA gallery and a switching gallery of a valve deactivation hydraulic circuit may be incorporated into the engine with reduced costs. Additionally, integrating the hydraulic restriction into the camshaft carrier reduces packing constraints. By providing an interchangeable oil filter to each vertical bore, maintenance costs may be reduced when compared to restrictor filters that are nonremovably integrated into the restrictor design.

Turning now to FIG. 4, it shows the bottom face 32 of a camshaft carrier 30, including a second embodiment 480 of a deactivation restrictor for a valve deactivation hydraulic circuit (e.g., hydraulic circuit 200 at FIGS. 2A and 2B). The upward direction points directly into the page at FIG. 4. In the second deactivation restrictor embodiment, first and second angular drillings couple each vertical filter bore to the restrictive groove, rather than including a direct coupling of the restrictive groove to each filter bore. In this way, the deactivation restrictor may be implemented across a wider range of packaging constraints of flushly adjacent surfaces of engine block components (e.g., across a wider range of dimensions of the flushly adjacent surfaces). It will be appreciated that a single camshaft carrier 30 may include each of the first and second deactivation restrictor embodiments at different positions along the bottom face 32. For example, a first VDE cylinder may include two deactivation restrictors of the first embodiment, and a second VDE cylinder may include two deactivation restrictors of the second embodiment. As another example, an intake side of each of a first VDE cylinder and a second VDE cylinder may include deactivation restrictors of the first embodiment, and an exhaust side of each of the first VDE cylinder and the second VDE cylinder may include deactivation restrictors of the second embodiment, or vice versa. Still other combinations of deactivation restrictor embodiments may be included within a camshaft carrier without departing from the spirit and scope of the present invention.

First vertical bore 484 may be coupled to an HLA gallery via an HLA gallery branch (e.g., as described with reference to FIGS. 2A and 2B, and depicted at FIG. 6). First vertical bore 484 may include a bore extending vertically from the bottom face 32 of camshaft carrier 30 toward a top end of the camshaft carrier, said bore terminating within the camshaft carrier. In this way, vertical bore 484 may couple the HLA gallery to a restrictive groove 482 along a bottom face 32 of camshaft carrier 30.

As shown, first oil filter 474 may be housed within first vertical bore 484 and may be configured to remove particulate matter from any hydraulic fluid passing therethrough. Oil filter 474 may be an interchangeable component. In this way, if oil filter 474 is degraded, it may be replaced without replacing other components (e.g., the entirety) of deactivation restrictor 480, thereby reducing maintenance costs.

First angular drilling 464 may extend from an outer diameter of first vertical bore 484 to the bottom face 32 of camshaft carrier 30. Specifically, first angular drilling 464 may extend downward and in an axial direction (e.g., from first end 90 to second end 92 of camshaft carrier 30) from the outer diameter of the first vertical bore and terminate at a first end 488 of restrictive groove 482. Thus first angular drilling 464 couples first vertical bore 484 to first end 488 of restrictive groove 482.

Restrictive groove 482 may extend along the bottom face 32 of camshaft carrier 30 in the direction of separation between the HLA gallery and the switching gallery of the circuit. As shown, restrictive groove 482 extends laterally (e.g., extending along the horizontal plane in the direction perpendicular to the axial direction), however it will be appreciated that the restrictive groove may extend in another horizontal direction without departing from the scope of the invention. Restrictive groove 482 is a groove that may be machined into the bottom face 32 of camshaft carrier 30. Restrictive groove 482 directly couples a first angular drilling 464 to second angular drilling 466, thereby coupling first vertical bore 484 to second vertical bore 486. Additionally, restrictive groove 482 is configured to restrict the flow of hydraulic fluid passing from first vertical bore 484 to second vertical bore 486, or vice versa. Restrictive groove 482 may be of a lesser hydraulic diameter or lesser cross-sectional area than each of the HLA gallery (not shown), first and second angular drills 464 and 466, first and second vertical bores 484 and 486, and a switching gallery (not shown). In this way, a more reliable restricting of hydraulic flow across the restrictive groove may be achieved.

Second angular drilling 466 may extend from an outer diameter of second vertical bore 486 to the bottom face 32 of camshaft carrier 30. Specifically, second angular drilling 466 may extend downward and in an axial direction (e.g., from first end 90 to second end 92 of camshaft carrier 30) from the outer diameter of the second vertical bore and terminate at a second end 489 of restrictive groove 482. Thus second angular drilling 466 couples second vertical bore 486 to second end 489 of restrictive groove 482.

Second vertical bore 486 may be directly coupled to a switching gallery (e.g., to restrictor branch 515 of switching gallery 514 at FIG. 5). In a similar manner as first vertical bore 484, second vertical bore 486 may extend vertically from the bottom face 32 of camshaft carrier 30 toward a top end of camshaft carrier 30, terminating within camshaft carrier 30. In this way, second vertical bore 486 may couple the switching gallery to a restrictive groove 482 along the bottom face 32 of the camshaft carrier.

As shown, second oil filter 476 may be housed within second vertical bore 486 and may be configured to remove particulate matter from any hydraulic fluid passing therethrough. Oil filter 476 may be an interchangeable component. In this way, if oil filter 476 is degraded, it may be replaced without replacing other components (e.g., the entirety) of deactivation restrictor 480.

Thus a second embodiment of the deactivation restrictor may comprise a first vertical bore within a camshaft carrier coupled to an HLA gallery within a cylinder head, a first angular drilling within the camshaft carrier directly coupling said first vertical bore to a first end of a restrictive groove. The restrictive groove may be machined into a bottom face of the camshaft carrier. A second angular drilling within the camshaft carrier may couple a second end of the restrictive groove to an outer diameter of a second vertical bore. The second vertical bore may be coupled to a top surface of an axial passage of a switching gallery via a restrictor branch of the switching gallery.

Turning now to FIG. 5, it shows a top-down, cross-sectional view of cylinder head 20, detailing the fluidic connectivities of a switching gallery (indicated generally at 514). It will be appreciated that FIG. 5 shows only the housings of a plurality of valve deactivation components within cylinder head 20, and omits the components themselves. Cylinder head 20 includes a plurality of spark plug bores 531 that may form a portion of the walls of the plurality of combustion chambers of the engine.

Switching gallery 214 may be coupled to a VDE OCV bore within a camshaft carrier cover (e.g., bore 41 within carrier cover 40 at FIG. 1). The VDE OCV bore may house a VDE OCV (e.g., VDE OCV 210 at FIGS. 2A and 2B). The VDE OCV bore may be directly coupled to switching gallery 514, and may be configured to provide hydraulic fluid to the axial passage 516 of the switching gallery. The view shown at FIG. 5 does not include said direct coupling, however it will be understood that switching gallery 514 extends from a first end 574 of the axial passage 516 toward the VDE OCV bore, thereby establishing fluidic communication between axial passage 516 and the VDE OCV. By establishing a direct coupling between the VDE OCV bore and switching gallery 514, a valve deactivation control valve may provide switching gallery 514 with hydraulic fluid at a pressure above a switching threshold pressure during select conditions, said fluid flowing from a first end 90 toward a second end 92 of the cylinder head. During other conditions, hydraulic fluid at pressure below the switching threshold pressure may be configured to flow from the second end 92 toward the first end 90 of the switching gallery, and may additionally carry any trapped pockets of air within switching gallery 514 toward the VDE OCV bore.

The axial passage 516 switching gallery 514 is shown extending from a first axial end 90 of cylinder head 20 and ending at a second axial end 92 of the cylinder head 20. Thus, as depicted, switching gallery 514 may comprise an axial bore entirely within cylinder head 20. Axial passage 516 of the switching gallery is directly coupled to two DHLA bores 533.

Each DHLA bore 533 may be configured to house a dual-function hydraulic lash adjuster (such as a DHLA 232 at FIGS. 2A and 2B). DHLA bore 533 may comprise a cylindrical bore extending vertically downward into cylinder head 20. An outer diameter of DHLA bore 533 may include each of a first opening 518 at a first angular position and a second opening 520 at a second angular position, said second angular position diametrically opposed to the first angular position. First opening 518 may provide a fluidic communication to an HLA gallery within the cylinder head (not shown), and second opening 520 may provide a fluidic communication with axial passage 516 of the switching gallery. In this way, a DHLA housed within DHLA bore 533 may receive hydraulic fluid from an HLA gallery and a switching gallery for each of lash compensation and valve deactivation, respectively. As shown, the DHLA bores are coupled to axial passage 516 at a position along the axial passage that is between a valve deactivation control valve and a restrictor branch 515. It will be appreciated that when a DHLA is provided within DHLA bore 533, there is no fluidic communication between the switching gallery and the HLA gallery of cylinder head 20 via DHLA bore 533. Put another way, the only coupling between said galleries is via the deactivation restrictor (such as one of deactivation restrictors 380 at FIG. 3 or 480 at FIG. 4).

Axial passage 516 is shown directly coupled to restrictor branch 515 of switching gallery 514. Specifically, restrictor branch 515 begins at a top surface of axial passage 516 and may extend upward toward a top face of cylinder head 20 (e.g., extend along the direction indicated by arrow 98). Restrictor branch 515 may couple axial passage 516 to a first end of a deactivation restrictor located along a bottom surface of a camshaft carrier (not shown), when said camshaft carrier is configured to rest on the top end of cylinder head 20. HLA gallery branch 513 may be coupled to a second end of the deactivation restrictor, as described in further detail with reference to FIG. 6. In this way, a hydraulic fluid may flow from an HLA gallery within cylinder head 20 (e.g., HLA gallery 512 at FIG. 6), through HLA gallery branch 513, and to a deactivation restrictor. A restricted flow of said hydraulic fluid may then flow to axial passage 516 via restrictor branch 515, and toward a VDE OCV bore within a camshaft carrier cover (e.g., bore 41 within carrier cover 40) via second end 574 of axial passage 516. In this way, any air entrapped within switching gallery may flow toward VDE OCV bore 511 via the restricted hydraulic flow.

A second end 519 of axial passage 516 is shown at the second end 92 of the cylinder head. Second end 519 of axial passage 516 may comprise a drilling access point within cylinder head 20 for forming the axial passage 516. Axial passage 516 may include a sealing plug (not shown) between restrictor branch 515 and second end 519 to hydraulically seal the switching gallery from the atmosphere. Said sealing plug may be positioned immediately adjacent to restrictor branch to reduce the volume of the portion of axial passage 516 between restrictor branch 515 and second end 519.

Upper water jacket 588 and lower water jacket 589 may be included in cylinder head 20 for cooling a plurality of features incorporated therein. A feed port 592 of an exhaust gas recirculation (EGR) system may be included within cylinder head 20 for circulating a portion of exhaust gases toward the intake conduit of the engine. Said exhaust gases may be cooled by an EGR cooler incorporated within the cylinder head, a drilling for which is shown at 590. Exhaust manifold coolant cross drill 595 may be configured to deliver coolant to an area adjacent to an exhaust manifold, thereby cooling the manifold and any exhaust gases flowing therethrough.

FIG. 6 shows a second top-down, cross-sectional view of cylinder head 20, detailing fluidic connectivity of HLA gallery 512. HLA gallery 512 may be an axial bore within cylinder head 20 (e.g., a bore extending from a first axial end 90 toward a second axial end 92 of cylinder head 20).

HLA gallery 512 is coupled to a plurality of openings 518 of DHLA bores 533, and to a plurality of openings 568 of HLA bores 563. DHLA bores 533 are configured to house DHLAs, and HLA bores are configured to house HLAs (such as HLAs 262 at FIGS. 2A and 2B). In this way, hydraulic fluid within HLA gallery 512 may flow to DHLAs and HLAs within respective DHLA bores 533 and HLA bores 563 for lash compensation.

HLA gallery branch 513 may extend upward from a top surface of HLA gallery 512 and toward a top end of cylinder head 20. HLA gallery branch 513 may be directly coupled to a first end of a deactivation restrictor (such as one of deactivation restrictor 380 at FIG. 3 or deactivation restrictor 480 at FIG. 4). A second end of the deactivation restrictor may be coupled to a switching gallery (e.g., switching gallery 514 at FIG. 5 as described above). In this way, a restricted amount of hydraulic fluid from HLA gallery 512 may flow to a switching gallery when hydraulic pressure within the HLA gallery is greater than hydraulic pressure within the switching gallery.

A second end 599 of HLA gallery 512 is shown at the second end 92 of the cylinder head. Second end 599 of HLA gallery 512 may comprise a drilling access point within cylinder head 20 for forming the HLA gallery. HLA gallery 512 may include a sealing plug (not shown) between restrictor branch HLA gallery branch 513 and second end 599 to hydraulically seal the switching gallery from the atmosphere. Said sealing plug may be positioned immediately adjacent to restrictor branch to reduce the volume of the portion of HLA gallery 512 between HLA gallery branch 513 and second end 599.

FIG. 7 provides an example routine 700 for operating the valve deactivation hydraulic circuit described with reference to FIGS. 2A and 2B, and further illustrated at FIGS. 1 and 3-6. Instructions for carrying out routine 700 and the rest of the routines included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

Routine 700 begins with the VDE cylinders (e.g., 230 at FIGS. 2A and 2B) activated and the VDE OCV (e.g., 210 at FIGS. 2A and 2B) de-energized. At 702, the dual-function hydraulic lash adjuster (e.g., DHLA 232 at FIGS. 2A and 2B) is supplied a lower hydraulic pressure via the switching gallery (e.g., gallery 214 at FIGS. 2A and 2B). Specifically, hydraulic fluid at a predetermined pressure may be pumped from an HLA gallery (e.g., HLA gallery 512 at FIG. 6) toward a hydraulic flow restrictor that is bored into the bottom face of a camshaft carrier (e.g., one of deactivation restrictors 380 or 480 bored into bottom face 32 of camshaft carrier 30 at FIGS. 3 and 4, via HLA gallery branch 513 at FIGS. 5 and 6). As one example, the hydraulic pressure may be pumped via an oil pump (such as oil pump 202 at FIGS. 2A and 2B). Additionally, the hydraulic flow restrictor may provide a switching gallery (e.g., gallery 216 at FIGS. 2A and 2B) with hydraulic fluid at the lower amount of hydraulic pressure at a passage of the switching gallery that is within the camshaft carrier (e.g., restrictor branch 315 at FIG. 3). Thus the lower amount of hydraulic pressure is a restricted amount of pressure and is provided via a restricted flow of hydraulic fluid. The switching gallery may provide the DHLA with the lower amount of pressure via an axial passage of the switching gallery (e.g., axial passage 516 of switching gallery 514 at FIG. 5). The switching gallery may additionally deliver hydraulic fluid at the lower amount of pressure to a pressure relief valve within a poppet valve deactivation control valve (e.g., pressure relief valve 244 within VDE OCV 210 at FIGS. 2A and 2B). In this way, a first lower pressure may be provided to a latch pin hydraulic chamber 222 within a valve deactivation mechanism while the VDE OCV is de-energized, and any air that may be entrapped within an HLA switching gallery may be promoted to flow to the pressure relief valve.

At 704, it is determined whether valve deactivation conditions are met. Valve deactivation conditions may include an engine load being below a threshold load. If valve deactivation conditions are met, routine 700 proceeds to 706. Otherwise, routine 700 proceeds to 708.

At 706, a higher hydraulic pressure is supplied to the switching gallery. As one example, the higher hydraulic pressure may be supplied by switching a VDE OCV from a de-energized state to an energized state, thereby promoting hydraulic fluid at the higher hydraulic pressure to flow from the VDE OCV toward the switching gallery. In this way, the unlatching of the inner and outer arms of the SRFF may be realized, and the poppet valve may be deactivated. Further, the duration between supplying the higher hydraulic pressure to the switching gallery and the unlatching of the inner and outer arms of the SRFF may be reduced because of the lower pressures maintained in the hydraulic circuit at 702. It will be appreciated that the higher pressure hydraulic fluid flows through the HLA switching gallery in the opposite direction of the flow of the hydraulic fluid at the first hydraulic pressure, as shown between FIGS. 2A and 2B. After 706, routine 700 terminates.

Thus the present invention contemplates a method for a cylinder deactivation hydraulic circuit, comprising flowing oil at a first pressure from a hydraulic flow restriction to a SRFF switching chamber via an oil gallery during a first condition, and flowing oil at a second pressure from a poppet valve deactivation control valve to the SRFF switching chamber via the oil gallery during a second condition. The hydraulic flow restriction utilized in the contemplated method comprises a lateral groove coupling a first oil bore and second oil filter bore, said second oil filter bore directly coupled to the oil gallery. The flowing of oil at the first pressure includes flowing oil from the hydraulic flow restriction to a pressure relief valve within the deactivation control valve, and wherein flowing oil at the second pressure includes flowing oil from the deactivation control valve to the hydraulic flow restriction. Additionally, the first condition may be an activated cylinder condition, and the second condition may be a deactivated cylinder condition. In some examples, the first pressure may be less than the second pressure. The method further includes where the oil gallery is supplied oil pressure from an HLA gallery and where the switching gallery directs entrapped air from each of the hydraulic lash adjuster and latch pin chamber of the rocker arms to the pressure relief valve within the VDE OCV. The method also includes where the DHLA switching passage provides hydraulic fluid to a deactivatable rocker arm switching chamber. The rocker arm may be one of a plurality of rocker arms which actuate a plurality of intake valves, and a second plurality of rocker arms may be in fluid communication with a second switching gallery.

The technical effect of providing a switching gallery a restricted flow of hydraulic fluid for promoting air flow away from valve deactivation components is to improve the transition time between activated and deactivated states of a valve actuation mechanism. The technical effect of incorporating a hydraulic flow restrictor into a bottom face of a camshaft carrier is to minimize costs associated with manufacturing a flow restrictor with tight tolerances by including the restrictor within pre-existing engine components. A further technical effect of incorporating the restrictor into the bottom face of the camshaft carrier is to reduce the amount of drilling between the restrictor and each of the HLA gallery and switching galleries that extend axially within the cylinder head. A still further technical effect of incorporating the restrictor into the bottom face of the camshaft carrier is to reduce packing constraints associated with hydraulic flow restrictors. Yet another technical effect of incorporating the hydraulic flow restrictor into the bottom face of the camshaft carrier is to reduce the number of components, thereby reducing costs and maintenance of the hydraulic flow restrictor. The technical effect of providing the hydraulic flow restrictor with interchangeable oil filters is to reduce maintenance costs associated with a hydraulic flow restrictor. The technical effect of terminating the switching gallery at a pressure relief valve within a VDE oil control valve is to maintain at least a consistent low pressure within the priming gallery.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example.

In another representation, the present invention contemplates an engine block, comprising a cylinder head, a camshaft carrier positioned atop the cylinder head, a DHLA bore, a poppet valve deactivation control valve (e.g., VDE OCV), a first axial bore extending from a first hydraulic flow restrictor to a lash compensation port of a DHLA housed within a DHLA bore, and a second axial bore extending from an outlet of the poppet valve deactivation control valve to a second hydraulic flow restrictor. The first axial bore is bored into the cylinder head. The second hydraulic flow restrictor is incorporated into a bottom face of the camshaft carrier. The second hydraulic flow restrictor couples the second axial bore to the first axial bore at a location between the first hydraulic flow restrictor and the lash compensation port. The second hydraulic flow restrictor of this representation includes a first vertical bore configured to flushly house a first oil filter therein, said first vertical bore coupled to a first axial bore within the cylinder head, a first angular drilling within the camshaft carrier directly coupling said first vertical bore to a first end of a lateral groove extending along a bottom face of the camshaft carrier. The second hydraulic flow restrictor further includes a second vertical bore configured to flushly house a second oil filter therein, said second vertical bore coupled to a second axial bore within the cylinder head. The second hydraulic flow restrictor of this representation further includes a second angular drilling directly coupling said second vertical bore coupled to the a second end of the lateral groove. The DHLA bore of the engine block is coupled to the first axial bore at a first angular position, and coupled to the second axial bore at a diametrically opposite position. The second axial bore is coupled to the DHLA bore at a position between the deactivation control valve and the second hydraulic flow restrictor. The hydraulic diameter or cross-sectional of the lateral groove is less than the outer diameters of the first and second vertical bores of the second hydraulic flow restrictor. The hydraulic diameter or cross-sectional area of the lateral groove is less than a diameter of the first angular drill and less than a diameter of the second angular drill. The second hydraulic flow restrictor restricts flow by a greater amount than the first hydraulic flow restrictor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A hydraulic circuit for an engine poppet valve deactivation mechanism, comprising:

a poppet valve deactivation control valve including an outlet that communicates with first and second oil galleries, the first and second oil galleries each communicating with a DHLA; and a hydraulic flow restriction which is hydraulically in series between the first and second oil galleries and which includes a restricted horizontal groove in a camshaft carrier that fluidly couples first and second vertical bores.

2. The hydraulic circuit of claim 1, wherein the first vertical bore houses a first oil filter and the second vertical bore houses a second oil filter.

3. The hydraulic circuit of claim 2, wherein the first oil gallery is in communication with a first port of the DHLA, and the second oil gallery is in fluidic communication with a second port of the DHLA.

4. The hydraulic circuit of claim 3, wherein the second oil gallery fluidically couples the second port to each of the poppet valve deactivation control valve and the hydraulic flow restriction, wherein the second port is hydraulically in series between the poppet valve deactivation control valve and the hydraulic flow restriction.

5. The hydraulic circuit of claim 4, wherein the poppet valve deactivation control valve includes:

a pressure relief valve in fluidic communication with the second oil gallery, and a switch for selectively providing an unrestricted flow of hydraulic fluid to the second oil gallery.

6. The hydraulic circuit of claim 5, wherein a restricted hydraulic fluid in the second oil gallery flows from the hydraulic flow restriction to the pressure relief valve of the poppet valve deactivation control valve when hydraulic pressure in the first oil gallery is greater than hydraulic pressure in the second oil gallery.

7. The hydraulic circuit of claim 6, wherein an unrestricted hydraulic fluid in the second oil gallery flows from the poppet valve deactivation control valve to the hydraulic flow restriction when the hydraulic pressure in the first oil gallery is less than the hydraulic pressure in the second oil gallery.

8. An engine block, comprising:

a cylinder head;

a camshaft carrier positioned atop the cylinder head;

a DHLA bore;

a poppet valve deactivation control valve;

a first axial bore extending from a first hydraulic flow restrictor to a lash compensation port of a DHLA housed within the DHLA bore; and a second axial bore extending from an outlet of the poppet valve deactivation control valve to a second hydraulic flow restrictor, wherein said second hydraulic flow restrictor couples the second axial bore to the first axial bore at a position between the first hydraulic flow restrictor and the lash compensation port;

wherein said second hydraulic flow restrictor includes:

a first vertical bore configured to house a first oil filter, a first cross drill coupling said first vertical bore to a location along the first axial bore downstream of the first hydraulic flow restrictor and upstream of the DHLA, a second vertical bore configured to house a second oil filter, a second cross drill coupling said second vertical bore to the second axial bore, and a horizontal groove extending from an outer diameter of the first vertical bore to an outer diameter of the second vertical bore.

9. The engine block of claim 8, further comprising:

the first oil filter flushly housed in the first vertical bore, and the second oil filter flushly housed in the second vertical bore.

10. The engine block of claim 9, wherein the DHLA bore is coupled to the first axial bore at a first angular position, and coupled to the second axial bore at a diametrically opposite angular position.

11. The engine block of claim 10, wherein the second axial bore is coupled to the DHLA bore at a position between the poppet valve deactivation control valve and the second hydraulic flow restrictor.

12. The engine block of claim 11, wherein a hydraulic diameter of the horizontal groove is less than the outer diameters of the first and second vertical bores.

13. The engine block of claim 12, wherein the hydraulic diameter of the horizontal groove is less than a diameter of the first cross drill and less than a diameter of the second cross drill.

14. The engine block of claim 13, wherein the second hydraulic flow restrictor restricts flow by a greater amount than the first hydraulic flow restrictor.

15. The engine block of claim 14, wherein the first axial bore is bored into the cylinder head.

16. The engine block of claim 15, wherein the second hydraulic flow restrictor is bored into a bottom face of the camshaft carrier.

* * * * *